US009808131B2

(12) United States Patent
Larsson et al.

(10) Patent No.: US 9,808,131 B2
(45) Date of Patent: Nov. 7, 2017

(54) STACK OF WEB MATERIAL FOR HYGIENE PRODUCTS

(71) Applicant: SCA Hygiene Products AB, Göteborg (SE)

(72) Inventors: Björn Larsson, Göteborg (SE); Inger Andersson, Varberg (SE); Gunnel Elglund, Göteborg (SE)

(73) Assignee: SCA Hygiene Products AB, Gothenburg (SE)

( * ) Notice: Subject to any disclaimer, the term of this patent is extended or adjusted under 35 U.S.C. 154(b) by 53 days.

(21) Appl. No.: 14/897,131

(22) PCT Filed: Jun. 10, 2013

(86) PCT No.: PCT/SE2013/050658
§ 371 (c)(1),
(2) Date: Dec. 9, 2015

(87) PCT Pub. No.: WO2014/200395
PCT Pub. Date: Dec. 18, 2014

(65) Prior Publication Data

US 2016/0120377 A1 May 5, 2016

(51) Int. Cl.
*B32B 3/06* (2006.01)
*A47K 10/42* (2006.01)
(Continued)

(52) U.S. Cl.
CPC ..... *A47K 10/42* (2013.01); *B65D 65/02* (2013.01); *B65D 83/0894* (2013.01);
(Continued)

(58) Field of Classification Search
CPC .... Y10T 428/24231; Y10T 428/24008; A47K 10/16
(Continued)

(56) References Cited

U.S. PATENT DOCUMENTS 5,033,620 A 7/1991 De Luca
6,286,712 B1 9/2001 Craig et al.
(Continued)

FOREIGN PATENT DOCUMENTS

AU 2007202525 B2 6/2007
CN 101080188 A 11/2007
(Continued)

OTHER PUBLICATIONS

Russian Search Report dated Feb. 17, 2017, issued by the Russian Patent Office in corresponding Russian Application No. 2015155598/12(085794). (3 pages).
(Continued)

*Primary Examiner* — Alexander Thomas
(74) *Attorney, Agent, or Firm* — Buchanan Ingersoll & Rooney P.C.

(57) ABSTRACT

A of web material for hygiene products includes at least one folded continuous web material, and a first connector and a second connector, adapted for interconnection of the first end surface of the stack to a second end surface of another, similar stack. The first connector includes a first connection surface consisting of a first material, and the second connector includes a second connection surface consisting of a second material; said first and second materials having properties that, upon bringing said first and second surfaces into contact with each other, the surfaces attach to each other by surface adhesion so that the surfaces are repeatedly removable from and reattachable to each other while leaving the surfaces substantially unaltered, whereby a connection between a first/second connector of the stack and a second/first connector of a similar stack is accomplished.

16 Claims, 9 Drawing Sheets

(51) Int. Cl.

| | |
|---|---|
| ***B65H 45/24*** | (2006.01) |
| ***B65D 83/08*** | (2006.01) |
| ***B65D 65/02*** | (2006.01) |
| ***B65D 85/62*** | (2006.01) |

(52) U.S. Cl.
CPC ..... *B65D 85/62* (2013.01); *B65H 45/24* (2013.01); *A47K 2010/428* (2013.01)

(58) Field of Classification Search
USPC ..... 428/99, 126
See application file for complete search history.

(56) References Cited

U.S. PATENT DOCUMENTS

| | | | | |
|---|---|---|---|---|
| 8,877,313 | B2 * | 11/2014 | Larsson | B65H 45/24 428/100 |
| 2004/0245140 | A1 | 12/2004 | Larsson et al. | |
| 2006/0051551 | A1 | 3/2006 | Shikano et al. | |
| 2012/0035038 | A1 * | 2/2012 | Lembach | B31D 5/0047 493/381 |
| 2013/0309461 | A1 | 11/2013 | Koike et al. | |

FOREIGN PATENT DOCUMENTS

| | | | |
|---|---|---|---|
| WO | 95/16425 | A2 | 6/1995 |
| WO | 2006/081355 | A1 | 8/2006 |
| WO | 2009/029522 | A2 | 3/2009 |
| WO | WO 2012/009593 | A1 | 1/2012 |
| WO | WO 2012/086791 | A1 | 6/2012 |
| WO | 2013/007301 | A1 | 1/2013 |
| WO | WO 2013/007303 | A1 | 1/2013 |

OTHER PUBLICATIONS

Notification of Transmittal of the International Search Report and the Written Opinion of the International Searching Authority, of the Declaration (Form PCT/ISA/220), International Search Report (PCT/ISA/210) dated Feb. 21, 2014, by the Swedish Patent Office as the International Searching Authority for International Application No. PCT/SE2013/050658. (6 pages).

Written Opinion of the International Searching Authority (Form PCT/ISA/237) dated Feb. 21, 2014, by the Swedish Patent Office as the International Searching Authority for International Application No. PCT/SE2013/050658. (6 pages).

Notification of Transmittal of the International Preliminary Report on Patentability (Form PCT/IPEA/416) and International Preliminary Report on Patentability (Form PCT/IPEA/409) dated Jun. 5, 2015, in the corresponding International Application No. PCT/SE2013/050658. (15 pages).

Extended European Search Report dated Nov. 11, 2016, issued by the European Patent Office in corresponding European Application No. EP 13886656.1 (7 pages).

Office Action (Notification of the First Office Action) dated Jul. 5, 2017, by the State Intellectual Property of the People's Republic of China in corresponding Chinese Patent Application No. 201380077273.X, and an English translation of the Office Action. (16 pages).

* cited by examiner

STACK OF WEB MATERIAL FOR HYGIENE PRODUCTS

TECHNICAL FIELD

The present disclosure relates to a stack of web material for hygiene products, comprising at least one web material being Z-folded about transverse folding lines, thereby providing panels having a length along said folding lines, and a width perpendicular to said folding lines, said panels being piled on top of each other to form a height of said stack.

BACKGROUND

Dispensers with web material, such as paper towels, napkins and similar hygiene products are often used in public lavatories as a convenient way of providing a supply of towels in washrooms and other facilities. Similar dispensers with web material are provided for supplying hygiene products intended for object wiping, e.g. for cleaning.

The web material may either be provided as a rolled web or as a stack of folded web. Rolls may often be heavy, and unrolling the web material from a roll will require overcoming a friction and a resistance against rotation. In addition, an arresting force will be required in order to stop rotation of the roll once a towel has been dispensed. Consequently, in such rolls, there is a need for a strong web material which may withstand the forces involved. On the contrary, web material which is provided as arranged in folded stacks does not need to have great physical strength, which usually is inconsistent with the desired characteristic of softness.

Dispensers in public lavatories are often designed with a lock which, in order to prevent pilferage and waste, only can be opened by an attendant. Thus, the products may run out before the next servicing and products may not always available to the user when needed. More frequent servicing means a higher labor cost which often is undesirable.

The selection of dispensers is often limited and they are only found in a few fixed sizes, which thus limit the design of the hygienic products as well. As easily understood, a larger dispenser requires less frequent servicing than a smaller one.

The dispenser is normally hanged on a wall or placed on the floor of the lavatory. To allow refill, the dispenser comprises an opening mechanism to provide access to a storage space of the dispenser for containment of a stack of web material.

It is preferred that the refilling of web material should not be heavy or difficult for the attendant to perform. Conventionally, refill packages are provided, each refill package comprising a stack of web material and a wrapping, which maintains the integrity of the stack during transport and storage thereof. For refill of the dispenser, the wrapping is removed from the stack, where after the stack is introduced into the storage space of the dispenser. Hence, each package is opened and fed to the dispenser by the attendant. Accordingly, conventional packages of web material are provided in sizes that are not too heavy and which easily can be gripped by the attendant, such that the integrity of the stack may be maintained manually while introducing the stack into the storage space of the dispenser.

In a dispenser, the web material will generally run from a storage space for containing the stack of folded material, to a dispensing opening. Hence, the dispenser will define a web path along which unfolded web material runs from said storage space to said dispensing opening.

In particular when it is desired to enable storing of a relatively large amount of web material in the dispenser, it has been proposed to arrange the storage space and the web path such that the web material is fed from the top of the stack.

Large-type dispensers may be provided with relatively large storage spaces, which may contain a number of such stacks of web material. Generally, in such dispensers, adjacent stacks are adhered to each other via their respective end panels, so that an end panel of each stack pulls along an end panel of the next stack. To this end, adhesive tape or glue is applied to the outer panel(s) of the stacks. Refill of a large dispenser with the presently available stacks of web material may hence involve the unwrapping, introduction and subsequent adhesion of several stacks of web material. Accordingly, the refill of a large dispenser may be rather time-consuming.

Thus, there is a continuing need for facilitating the refill procedure, and/or to find useful alternatives for providing interconnection between stacks of web material.

It is the object of the present disclosure to fulfill at least one of the above-mentioned needs.

SUMMARY

In accordance with the present disclosure there is provided a stack of web material for hygiene products, comprising at least one web material being Z-folded about transverse folding lines, thereby providing panels having a length along said folding lines, and a width perpendicular to said folding lines, said panels being piled on top of each other to form a height of said stack. Said first end surface is provided with a first connector, and said second end surface is provided with a second connector, said first and second connectors being adapted for interconnection of the first and/or second end surface of the stack to a second and/or first end surface of another, similar stack via said connectors.

The first connector comprises a first generally smooth connection surface consisting of a first material, and the second connector comprises a second generally smooth connection surface consisting of a second material; said first and second materials having such properties that, upon bringing said first and second smooth surfaces into contact with each other, the surfaces attach to each other by surface adhesion of the kind where the surfaces are repeatedly removable from and reattachable to each other while leaving the surfaces substantially unaltered, whereby a connection between a first/second connector of the stack and a second/first connector of a similar stack having a connection strength in a plane including the first and second connection surfaces sufficient to pull the web of the interconnected stacks is accomplished.

Advantageously, said web material may be a continuous web material. By "continuous web material" is meant a material which may be continuously fed for example when arranged in an appropriate dispenser. The web material may be integral, and intended to be severed into individual products upon actuation of a user, e.g. by a cutting blade or edge arranged in an appropriate dispenser. Alternatively, the continuous web material may be provided with weakening lines, such as perforation lines, along which the web material is to be separated to form individual products. Such separation can take place automatically inside a dispenser, or be performed manually, e.g. by tearing.

The connectors are to be connectors for interconnecting the end surfaces of the stacks to other, similar stacks, as is required when the stacks are to be used in a dispenser having a large storage space housing several stacks.

The connectors are each to comprise a generally smooth connection surface. That the surface is "generally smooth" is to be understood on a mechanical level. The connection between the surfaces is to be non-mechanical—there is no mechanical adhesion between the surfaces, such as e.g. in hook and loop or mushroom systems. Typically, such structures being intended to perform mechanical adhesion will display heights of at least 0.1 mm.

However, that the surfaces are "generally smooth" does not hinder that they may be provided with microstructures, provided that these microstructures are sufficiently small to contribute to surface adhesion (not to mechanical adhesion).

To this end, the microstructures could suitably be structures having a structure height being less than 100 μm.

The connector surfaces interconnect via surface adhesion of the kind where the surfaces are repeatedly removable from and reattachable to each other while leaving the surfaces substantially unaltered.

This is to be understood to exclude chemical adhesion, where two adhering materials may form a compound. The surface adhesion between the connectors is to be non-chemical.

Moreover, adhesion via many types of glue is excluded, since such adhesion will generally alter the connection surfaces in that the glue will tend to at least partially leave one of the connection surfaces, and residues thereof will appear on the other of the connection surfaces, when the surfaces are removed from each other after an initial interconnection.

Indeed, also when using removable glues such as found e.g. on Post-it notes, the attachment and removal of the note to a substrate will result in the surface (i.e. the layer of glue) being altered.

With "surface adhesion" is meant herein the tendency of surfaces to attach or cling to each other. Such adhesion will leave the adhering surfaces substantially unaltered. This is in contrast in particular to attachments relying on glues as mentioned in the above.

Moreover, the surface adhesion between two surfaces brought close to each other does not diminish even if the surfaces are removed from and reattached to each other a large number of times. The unaltered surfaces will produce an unaltered result, when reattached.

This again differs from connectors being interconnected using glue, since the modifications produced in the glue with each opening and reattachment of the connector surfaces to each other, will generally diminish the strength of the interconnection.

Herein it is suggested to use a new kind of connectors, relying on surface adhesion for connection between stacks of folded material. Such surface adhesion generally depends on forces which appear when the first and the second surfaces are brought into close contact to each other.

In many dispensers, particularly of the larger kind, the web material is to be run along a web path and through a number of devices before being fed to a user. Such devices could include various rollers, cutters, perforation cutters, and the like. Connectors as proposed herein may be designed such that they may pass these various devices without hindering the web, and without leaving residues on the devices themselves.

A connection between a first and a second connector as described herein will display a connection strength in a plane including the first and second connection surfaces. When a web of interconnected stacks is pulled, shear forces will appear in this plane, between the first and second connector. Said shear forces reflect the strength of connection and hence the ability of the connection to withstand pulling forces in a direction along said plane. In use, such as when the interconnected web material is drawn through a designated dispenser, the connection will be subject to load by forces predominantly in this plane.

The connection strength will reflect the strength of the connection, when the web of the interconnected stacks is pulled, such as when the interconnected web material is drawn through a designated dispenser. Accordingly, the relevant connection strength is in a direction along the interconnected webs.

To ensure the proper feeding of the interconnected web, the connection strength between the connectors should be greater than the force required to pull a product of the web from the dispenser. Otherwise, there is a risk that the connection will break during the feeding of the web in the dispenser.

Moreover, if the web is continuous and provided with weakening lines, dividing the web into individual sheets, it is advantageous if the connection strength is higher than the force required to rupture the web along the weakening lines. Accordingly, it is ensured that the web breaks at the weakening lines rather than at the interconnection between the connectors.

Generally, surface adhesion connectors will provide a connection being relatively strong as concerns shear forces, but relatively weak as concerns peel forces (forces in a direction perpendicular to the plane including the connector surfaces). In the practical suggested application for interconnection of web material, only the strength in a shear direction of the interconnection will become relevant for pulling the web material along.

The relatively weak resistance to peel forces may provide an advantage in that the interconnection is easily openable by peeling at the ends of the connectors. This may be useful if it is ever desired to reopen a first interconnection of the connectors, e.g. in order to reposition the stack before reattachment to a previous stack.

For many applications, the connection strength between the two connectors should be at least 1 N, preferably at least 2 N, most preferred at least 4 N.

Advantageously, said first and second materials are selected such that, upon bringing said first or second smooth surface into contact with the web material, no surface adhesion occurs.

Web materials such as tissue materials will generally not have a surface which is suitable for surface adhesion with the intended connector materials. This provides an advantage, since there is no risk that the connectors will unintentionally fasten onto an improper portion of the web material of the stack. Instead the connectors will create an interconnection only when brought close together.

Advantageously, the first and second materials are selected such that the surfaces attach to each other by surface adhesion of the kind resulting mainly from intermolecular interactions between the molecules of the respective surfaces.

An example of such intermolecular interactions is Van der Waals forces. Van der Walls forces are relatively weak forces, created by the attraction between two molecules, one having a slight positive and the other a slight negative charge. Van der Waals forces explain several types of surface adhesion.

Surface adhesion is used in removable stickers that adhere to smooth surfaces such as glass, without the need for any adhesives. Such stickers may be applied and removed a number of times without losing their adhesive properties. Previously, this type of products has mostly been used for marketing, decoration and toys. Known materials used e.g. as removable stickers often comprise relatively thin polymer sheets with a generally smooth surface.

In accordance with what is proposed herein, materials providing surface adhesion are used in new context where the interconnections formed are able to withstand the forces involved when pulling a web through a dispenser. Hence, what is proposed herein is to apply a load to an interconnection relying primarily on surface adhesion. This deviates from the previous, primarily decorative or informative uses of this type of adhesive surfaces.

Surface adhesion may be enhanced by at least one of the connector surfaces displaying a microstructure. For example, if a surface is made with a pattern of small wells, and placed on a smooth surface (with the wells upside down), intermolecular forces will attract the surfaces to each other such that the wells collapses and the bottoms of the wells are drawn towards the smooth opposing surface.

Moreover, materials intended for surface adhesion may sometimes be provided with micro-apertures. Seemingly, the purpose of the apertures is to avoid air becoming trapped between the contact surfaces. Such trapped air might hinder the close contact between surfaces that is necessary for the surface adhesion to occur.

Some materials suitable for surface adhesion are polar materials, for example polyurethane films. Such strongly dipolar films will connect to other polar materials, which is why, in this example, the polarity of the materials is involved in the surface adhesion.

Other materials suitable for surface adhesion may be non-dipolar, such as polyethylene films. Such materials might display a strong tendency to adhere to themselves, when brought close together.

In view of the above, a wide variety of materials might be suitable for connectors relying on surface adhesion as suggested in the above.

Specific materials which may be suitable for connectors relying on adhesive connection may include e.g. materials sold under the trademarks YupoTako®, YupoJelly®, and Yupo® static.

Another type of microstructure are gecko-type surfaces, where a microstructure on the surface form microscopic synthetic setae mimicking the function of the foot of a gecko. This type of adhesion mechanism is believed to primarily be based on van der Waals forces.

When one connection surface is provided with a microstructure, it may be preferred that the other one of the connection surfaces displays no microstructure, so as to provide sufficient strength of the connection.

Moreover, the surface adhesion may comprise electrostatic adhesion. Electrostatic adhesion appears when electrons are passed between the connection surfaces. This creates an attractive electrostatic force between the materials.

Materials providing electrostatic adhesion are found e.g. among films used for protection of smooth surfaces, such as protection films for lcd displays, screens, and windows. Such films are intended to protect the products during transport and storage thereof, and are removed before use of the product.

An example of such a film may be found in WO 2012 086791 describing an electrostatic adhesive sheet.

Under practical circumstances, it might be difficult to determine precisely which effects—what is referred to herein as intermolecular forces, diffusive adhesion or electrostatic adhesion—occur. It will be understood that a connection between two connector materials might display several of the above-mentioned properties.

For the purpose of the present idea, it is generally sufficient to determine that one or more of these effects provide a connection of the desired type, by determining that the connection is indeed reattachable, and that the connector surfaces are not altered by continued attachment and detachment.

If it is desired to use one specific adhesive property out of the adhesive effects described in the above, it is generally sufficient to determine which effect is principal for causing the surface adhesion. Other effects might be present along with the principal effect, but not to an extent being relevant to the result.

The first and second connector surfaces may be similar surfaces. For example, two polyurethane surfaces may be used as the first and second connector surfaces.

The first and second connector surfaces may be different surfaces. For example, the first connector surface may be a polyurethane surface, and the second connector surface may be a polyethylene surface.

The first and/or second connector may advantageously consist of a homogenous piece of material forming the connector as a whole including the connection surface.

Alternatively, the first and/or second connector may comprise a layer of a material forming the connection surface. For example, the connector may comprise a bearer material onto which a layer of connection surface material is applied.

In order to protect the connector surface from wear and/or dirt, the first and/or second connector may initially be covered by a removable release material.

The first and/or second connector may be fastened to the stack via a fastener, such as an adhesive.

Alternatively, the first and/or second connector may be formed directly on the stack, e.g. by a material being sprayed or extruded onto the stack. For example, a polymer material may be sprayed directly onto the stack, so as to form a connector when dried and/or hardened.

Moreover, the stack may be provided with a wrapper encircling said stack, so as to form a package suitable for storage and for handling of the stack. The wrapper may conveniently be formed from a material which is slidable against the connectors of the stack. Accordingly, if the wrapper is brought to slide over a connector, it will display no tendency to stick to the connector. This ensures that the removal of the wrapper from the stack will not be hindered or rendered more difficult by the presence of the connectors. This is of particular advantage if the wrapper is to be removed in a manner where it is allowed to slide underneath a portion of the stack, as will be described hereinbelow.

That a material is slidable against the connectors implies that the friction created between the wrapper material and the connector is relatively low.

Plastic films such as polyethylene or polypropylene films are often used as wrappers, and could be used in combination with the disclosed connectors if care is taken to select films which do not tend to fasten to the connectors.

Advantageously, micro-embossed films may be used for the wrappers, the purpose of the micro-embossment being to lower the friction between the film and a connector.

In another aspect there is provided a compound stack comprising a first and a second stack in accordance with the above, said first and second stack being interconnected via their first and second connectors.

In another aspect, there is suggested the use of a first generally smooth connection surface consisting of a first material, and a second generally smooth connection surface consisting of a second material; said first and second materials having such properties that, upon bringing said first and second smooth surfaces into contact with each other, the surfaces attach to each other by surface adhesion of the kind where the surfaces are repeatedly removable from and reattachable to each other while leaving the surfaces substantially unaltered, for interconnecting stacks of folded web material in a dispenser.

The areas of the first connector, and the second connector, respectively, may largely correspond to each other.

However, the total area of the first end surface covered by the first connector may also be smaller than the total area of the second end surface covered by the second connector.

Having a first connector with a smaller panel area than the second connector allows for minimisation of said first connector. Easy interconnection between stacks may still be achieved since the larger second connector will provide for a large connection surface. If the first (smaller) and second (larger) connectors are different when it comes to properties that might be perceived as disturbing to a user, e.g. stiffness, it is preferred that the first connector is formed of the most disturbing (e.g. stiff) material, so as to minimise the presence thereof in the stack.

Advantageously, the first connector may cover a panel area being less than 50% of the panel area covered by the second connection means, more preferred less than 30%, most preferred less than 20%.

Advantageously, both the first and the second connector are symmetrically arranged in view of the width of the stack, preferably centrally arranged. When the first and second connectors are symmetrically arranged in view of the width of the stack, it is possible to turn the stacks in either way, and still achieve interconnection between the stacks. Preferably, the first and second connector may be centrally arranged in view of the width of the stack.

For similar reasons, at least one of the first and second connectors is preferably symmetrically arranged in view of the length extension (L) of the stack, preferably centrally arranged.

Advantageously, at least one of the first and second connectors, preferably both, extends along essentially the entire length (L) of the stack. This feature is advantageous for reasons of production, where a piece of material may conveniently be attached all over the length of the stack.

In another variant, at least one of the first and second connectors, preferably both, extends along the majority of the length of the stack, leaving the side portions of the web free from connector. In this case, the connector may extend over more than 75% of the length, but less than 90% of the length. This variant may be advantageous in particular if the stack is intended for a particular dispenser being sensitive to added material at the edges of the web, perhaps if a relatively thick connector material is used.

Advantageously, at least one of the first and second connectors may consist of a continuous piece of connector material.

Alternatively, at least one of the first and second connectors comprises a plurality of pieces of connector material, intermittently arranged to said stack. In this case, the total area covered by the connector is the sum of the areas covered by the plurality of pieces of connector material.

In another variant, at least one of the first and second connectors may comprise connector material being attached to a support material, which support material is attached to the stack.

In this case said support material extends along essentially the entire length direction of the stack, and said connector material extends along less than 50% of the length direction, preferably less than 25%.

Advantageously, at least one, preferably both, of said connectors comprises connector material being adhesively attached to said stack. The connector material may be glued to said stack during production thereof, or the connector material may be provided as a sticker material being attached to the stack.

The first connector may have an extension in the width direction of the stack of less than 3 cm, preferably less than 1.5 cm, most preferred less than 0.5 cm.

The first connector may cover a panel area of less than 120 $cm^2$, preferably less than 60 $cm^2$, most preferred less than 30 $cm^2$.

The second connector may have an extension in the width direction of the stack of less than 8.5 cm, preferably less than 6 cm, most preferred less than 5 cm.

The second connector may cover a panel area of less than 120 $cm^2$, preferably less than 60 $cm^2$, most preferred less than 30 $cm^2$.

Advantageously, the continuous web material may be provided with weakening lines, preferably perforation lines, dividing said web material into individual sheets.

Moreover, there is provided a stack in accordance with the above, wherein said stack comprises a first web material divided into individual sheets by means of lines of weakness, and a second web material divided into individual sheets by means of lines of weakness, said first and second webs being interfolded with one another so as to form said stack, and the first and the second webs are arranged such that the lines of weakness of the first web and the lines of weakness of the second web are offset with respect to each other along the webs.

When the stack comprises at least two webs, the attachment of said connector to the stack may simultaneously accomplish interconnection of the first and second webs at said connector. Hence, it is ensured that all webs of the stacks are interconnected via the connectors.

Alternatively, the two webs should be interconnected adjacent said connector such that both webs of the stack will be fed when the web of the other, interconnected stack is pulled.

In another aspect of the disclosure there is provided a package comprising a stack in accordance with the above, and a wrapper extending at least over said height direction (H), so as to maintain the integrity of the stack during transport and storage thereof.

Advantageously, the wrapper may be provided with an indicia indicating a correct position of the package for connection of said stack to another, similar stack via their respective connectors. Such an indicia will facilitate the refill process by removing the need for an attendant to check the ends of the stack to ensure that a first connector of a stack is directed towards a second connector of another, adjacent stack.

In another aspect of the disclosure there is provided the use of a stack in accordance with the above in a dispenser including a housing having a storage space for said stack.

In another aspect of the disclosure there is provided a dispenser comprising a housing having a storage space including a stack in accordance with the above, preferably said storage space being arranged in the dispenser such that web material is fed from the top side of the stack.

Moreover, there is provided a method for loading stacks in a dispenser including a housing having a storage space for storing at least two stacks, said storage space comprising at least a portion of an initial stack, comprising: providing a stack as described in the above, positioning said stack on a support surface, such that the stack rests on one of its outer surfaces facing said support surface; interconnecting said stack with the initial stack, via said connector, while the stack remains resting on said support surface.

Advantageously, the stack is provided in a package as described in the above, and the method comprises: removing the wrapper from the stack while it rests on said support surface, prior to interconnecting said stacks.

Moreover, there is provided a method for loading a stack in a dispenser including a housing having a storage space for storing said stack comprising: providing a package in accordance with the above, positioning said package on a support surface, such that the stack rests on one of its outer surfaces facing said support surface removing the wrapper of said package, while the package is resting on said support surface.

Advantageously, the outer surface upon which the stack is resting is a back, front or side surface of the stack, preferably the back or front surface of the stack.

Preferably, the storage space is arranged in said dispenser such that the web is to be fed from the top side of the stack.

Also, there is provided a compound stack comprising a plurality of stacks as described in the above, said stacks being interconnected via their respective connectors, and said compound stack comprising interconnections being distributed less frequently than at every $640^{th}$ panel, preferably less frequently than at every $800^{th}$ panel, most preferred less frequently than at every $1000^{th}$ panel.

The present disclosure will now be further described using exemplary embodiments as depicted in the enclosed drawings wherein:

BRIEF DESCRIPTION OF THE DRAWINGS

FIG. 1' illustrates a portion of the stack of FIG. 1, where the connector is provided with a cover sheet;

Similar reference numbers denote similar features in the Figures.

DETAILED DESCRIPTION OF PREFERRED EMBODIMENTS

Figure 1:
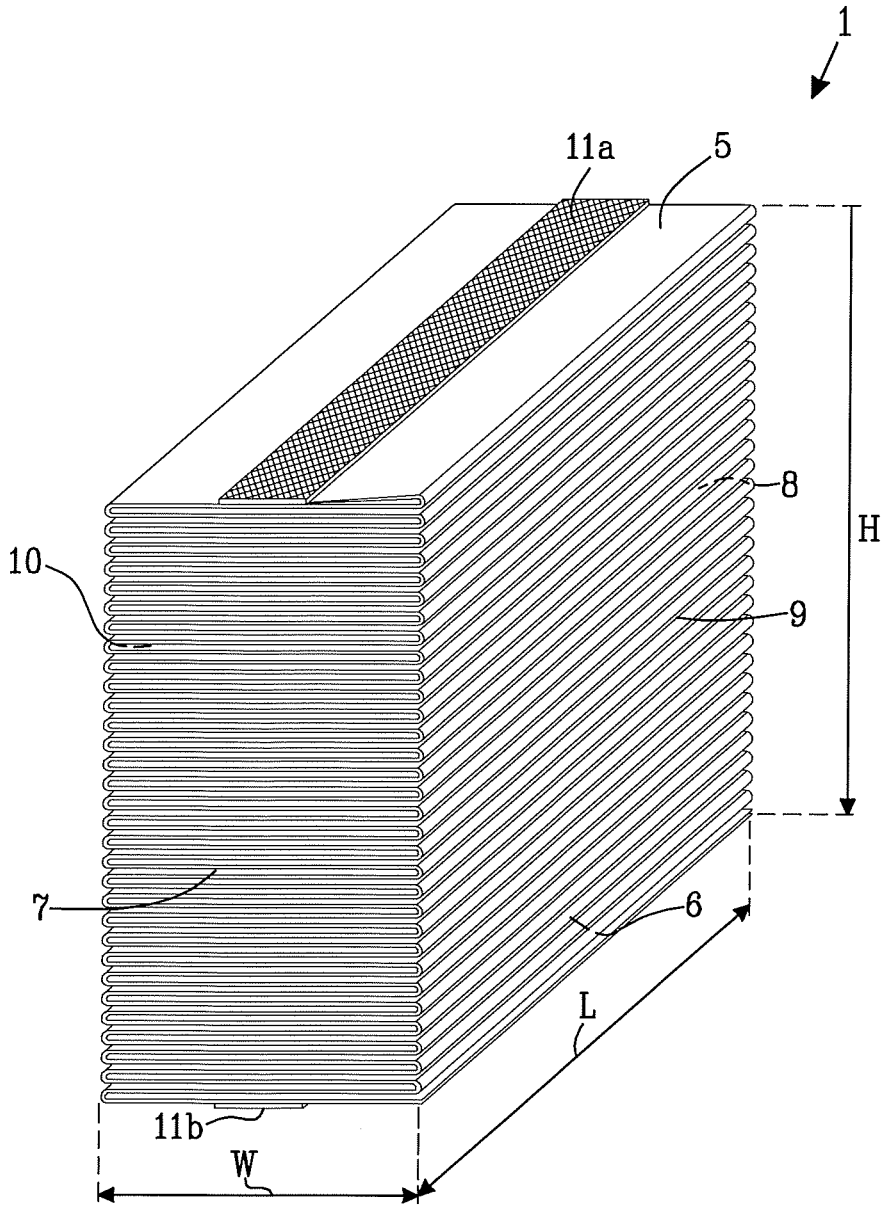
FIG. 1 illustrates an embodiment of a stack of web material comprising connectors.
Figure 1:
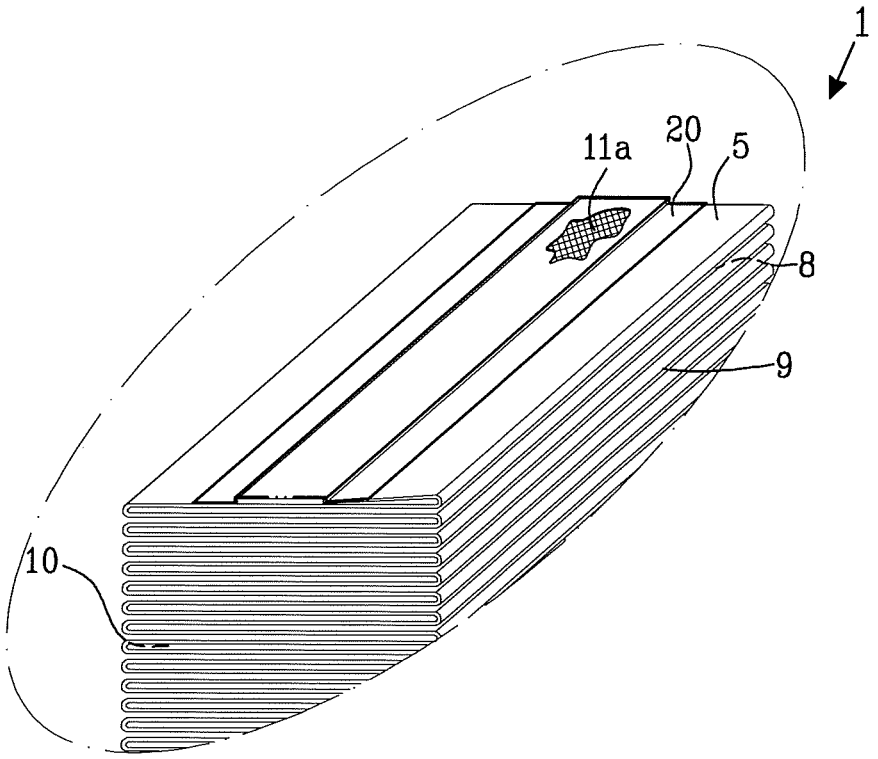
Figure 4:
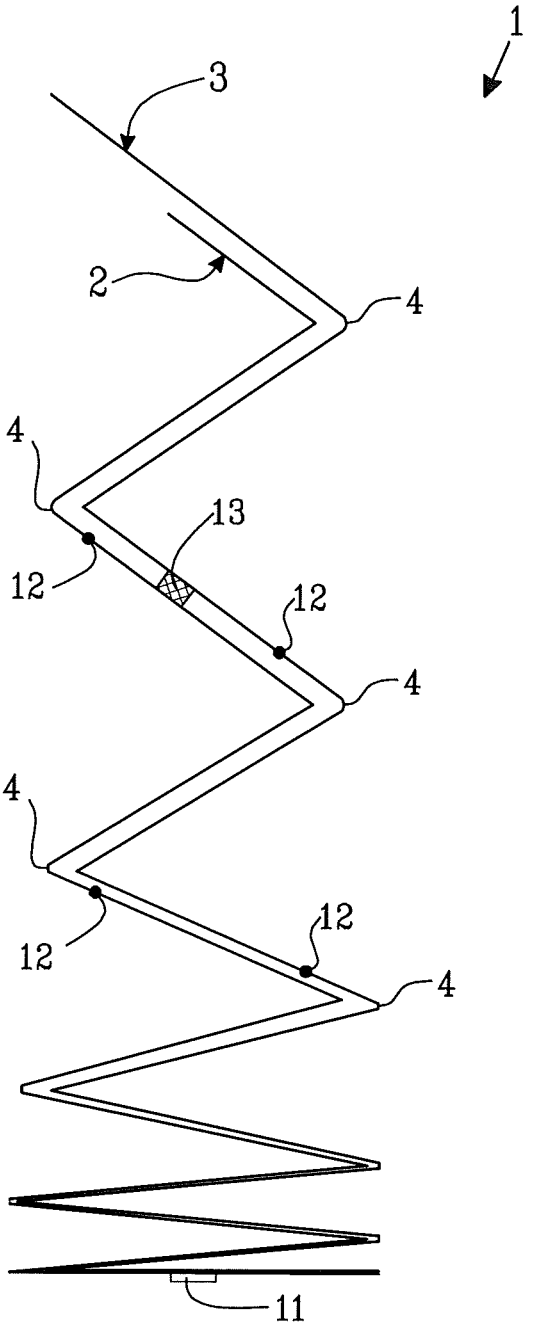
FIG. 4 illustrates an embodiment of a stack of web material

FIG. 1 together with FIG. 4 illustrate an embodiment of a stack 1 of web material for hygiene products, for use in a dispenser.

The stack 1 comprises at least one continuous web material 2, 3 being Z-folded about transverse folding lines, thereby providing panels having a length L along said folding lines, and a width W perpendicular to said folding lines. The panels are piled on top of each other to form a stack, having a height H. Accordingly, said stack outlines a rectangular parallelepiped having said length L, width W and height H. The parallelepiped will have six outer surfaces:

- A top surface 5 and a bottom surface 6, both being parallel to the panels of said stack 1.
- Two side surfaces 7, 8, which are generally formed by the longitudinal edges of the Z-folded web material.
- A front surface 9 and a back surface 10, which are generally formed by the folded edges of the Z-folded web material.

As explained in the above, with "continuous web material" is meant a material which may be continuously fed for example when arranged in an appropriate dispenser. Preferred web materials are in particular such that are suitable for forming absorbent tissues for personal use, e.g. for wiping the hands of a user after wash, for napkins, or for object wiping purposes.

The term "web material" is herein to be understood to include tissue paper materials, nonwoven materials, and materials being a mixture of tissue paper and nonwoven materials.

The term "tissue paper" is herein to be understood as a soft absorbent paper having a basis weight below 65 $g/m^2$ and typically between 10 and 50 $g/m^2$. Its density is typically below 0.60 $g/cm^3$, preferably below 0.30 $g/cm^3$ and more preferably between 0.08 and 0.20 $g/cm^3$. The tissue paper may be creped or non-creped. The creping may take place in wet or dry condition. The tissue paper may be made by TAD or atmos-methods. The fibres contained in the tissue paper are mainly pulp fibres from chemical pulp, mechanical pulp, thermo mechanical pulp, chemo mechanical pulp and/or chemo thermo mechanical pulp (CTMP). The tissue paper may also contain other types of fibres enhancing e.g. strength, absorption or softness of the paper. These fibres may be made from regenerated cellulose or synthetic material such as polyolefins, polyesters, polyamides etc.

The term "nonwoven" is applied to a wide range of products which in term of their properties are located between the groups of paper and cardboard on the one hand and textiles on the other hand. As regards nonwovens a large number of extremely varied production processes are used, such as airlaid, wetlaid, spunlaced, spunbond, meltblown techniques etc. The fibres may be in the form of endless fibres or fibres prefabricated with an endless length, as synthetic fibres produced in situ or in the form of staple fibres. Alternatively, they may be made from natural fibres or from blends of synthetic fibres and natural fibres.

The web material of the multi-ply web may comprise recycled fibres, virgin fibres, or a combination thereof.

Naturally, it will be understood that the use of connectors as proposed herein is not limited to stacks as those described in the illustrated embodiments. For example, the stack could instead comprise one single, continuous web material, or several interfolded continuous web materials.

The continuous web material may be integral, such that it may be torn or cut into individual products at selected locations, e.g. in a dispenser.

Alternatively, the continuous web material may comprise weakening lines, along which the web is intended to be severed for formation of individual products.

FIG. 4 illustrates an example of a stack, where the stack comprises two webs 2, 3 of material, which are interfolded. In this embodiment, the first and the second web material 2, 3, are each divided into individual sheets by lines of weakness 12. Moreover, the first and the second webs 2, 3 are arranged such that the lines of weakness of the first web and the lines of weakness of the second web are offset with respect to each other along the webs.

A stack 1 in accordance with this embodiment has the advantage that the webs 2, 3 may be automatically fed in a dispenser, requiring only the force from a user pulling one of the webs 2 to accomplish automatic feeding of the other web 3.

When the stack comprises weakening lines dividing the web into individual products, a separation strength of the weakening lines may advantageously be in the range 1-30 N, preferably 3-20 N, most preferred 3-10 N. (The separation strength may be determined in accordance with a method as described below.)

Advantageously, the weakening lines may be perforation lines. The geometry of the perforations may be selected to provide suitable strength in accordance with the web material and the dispenser to be used.

The perforation lines may be formed by alternating bonds and slots. It has been found that a remaining bonded length, being the total bond length/(total bond length+total slot length) between 4% and 50%, preferably between 4% and 25%, most preferred between 4% and 15%, is suitable for many relevant applications. The total bond length/(total bond length+total slot length) may be used as an indication of the strength of the perforation line. It is desired to form perforation lines which are strong enough to enable feeding of the web material from the stack in a suitable dispenser, but which are also weak enough to enable separation of the sheets. In this context, it is known that other parameters will also influence the strength of the perforation line, such as the web quality, and the size, shape and distribution of the slots and tabs. The above-mentioned measure may therefore be useful for guiding the person skilled in the art when selecting suitable perforation lines.

In the embodiment illustrated in FIG. 4, the weakening lines 12 of each one of the webs 2, 3, always appear at the same distance from the folded edges 4 of the stack 1. Accordingly, the distance between two consecutive weakening lines 12 is evenly divisible with the distance between two consecutive folding lines 4 (=the width W of the stack 1). In other words: (the distance between two consecutive weakening lines 12)/(the distance between two consecutive folding lines 4)=an integer greater than zero.

Alternatively, the distance between two consecutive weakening lines 12 could be selected so as not to be evenly divisible with the distance between two consecutive folding lines 4. In this case, the weakening lines 12 will appear at various distances from the folding lines 4, as seen from the side surfaces 7, 8 of the stack 1. This might be preferred, since such a stack 1 may avoid experiencing problems due to irregularities in the panels due to the presence of the weakening lines 12, and being multiplied over the height of the stack. In particular, such problems may become pronounced for stacks 1 having relatively great heights and/or including a relatively large number of panels. By securing that the weakening lines 12 will become distributed over the width of the stack 1, any irregularities are also distributed, and the stability of the stack 1 may be improved.

Moreover, the distance between consecutive weakening lines 12 being other than evenly divisible with the width W of the stack 1 enables the length of the products to be selected freely, without limitations involving considerations of the width W of the stack. The width W of the stack 1, as well as the length L are usually be selected in accordance with the size of a storage space in a housing of a dispenser from which the web material 2,3 is to be dispensed.

In this context, it has also been found to be advantageous if the weakening lines 12 are distributed along the web such that essentially no weakening line 12 will coincide with a folding line 4 in the stack. This is because a weakening line, in particular a perforation line, being simultaneously a folding line might give rise to a crease in the web material which is not smoothed out as much as other folding lines when the web is unfolded to be fed through a dispenser. Hence, such a crease could give rise to unwanted irregularities when feeding the web material. In particular when two or more webs are used, such a crease in one web might result in that web becoming unsynchronised with the other web (s).

The above descriptions regarding the weakening lines are equally applicable to stacks 1 including one single, two, or more continuous material webs.

Moreover, in the embodiment of FIG. 4, the first web material 2 and the second web material 3 are joined to each other at a plurality of joints 13 along said webs 2,3. Preferably, said joints 13 are regularly distributed along the webs 2,3. Joints 13 between the first and the second web 2,3 serve the purpose of hindering the webs from becoming asynchronous during feeding of the webs in a dispenser.

This may be of particular importance when stacks are used including relatively long web lengths, that is for stacks having a relatively great height and/or including a relatively large number of panels. Where long web lengths run uninterrupted, there might be an increased risk that the two webs 2, 3 in a stack 1 become unsynchronised during feeding thereof from the stack. This is particularly the case when the web is fed from the top of the stack, as seen when the stack is arranged in the dispenser. With appropriately distributed joints between the two webs, any such risks may be avoided or diminished.

The joints 13 could connect the material surfaces, i.e. the panel surfaces, of the webs 2, 3 to each other, or they could connect the longitudinal edges of the webs to each other. The joints 13 could be distributed in different numbers, sizes and patterns. Preferably, the joints 13 could be in the form of adhesive.

The total length of the web material in the stack may be at least 45 m, preferably at least 60 m, most preferred at least 75 m.

The stack may comprise at least 640, preferably at least 800, most preferred at least 1000 panels.

A stack may advantageously comprise at least 160, preferably at least 200, most preferred at least 250 individual sheets.

The stack is intended for connection to other stacks, so as to form a combined stack filling the storage space of a relatively large dispenser. To this end, the stack 1 illustrated in FIG. 1 comprises a connector 11*a* arranged on the top surface 5 of the stack, and a second connector 11*b* arranged on the bottom surface 6 of the stack 1.

In accordance with what is proposed herein the connectors 11*a* and 11*b* comprise a first and a second, respectively, generally smooth connection surface consisting of a first and a second material. The first and second materials have such properties that, upon bringing said first and second smooth surfaces into contact with each other, the surfaces attach to each other by surface adhesion of the kind where the surfaces are repeatedly removable from and reattachable to each other while leaving the surfaces substantially unaltered.

To this end, the first and second materials may be selected from materials for providing surface adhesion created by intermolecular effects appearing between the two surfaces when brought in to close contact with each other, or by diffusive or electrostatic adhesion as described in the above.

Such materials are often provided in the form of polymeric films which may be cut to desired size and proportion to be useful as connectors.

The connection strength between the first and second connector are such, that the connection may withstand a force sufficient to pull the web of the interconnected stacks.

Figure 6:
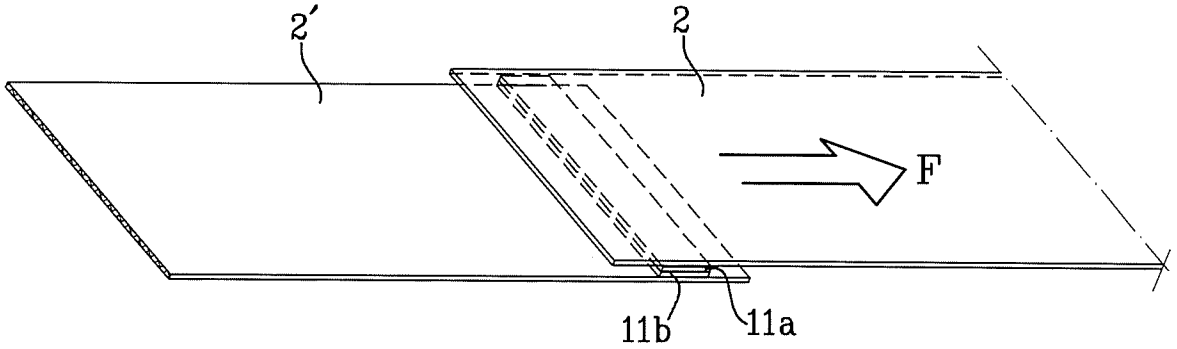
FIG. 6 illustrates the direction of a force when a web of interconnected stacks is pulled.

FIG. 6 illustrates a web 2 from a first stack and a web 2' from a second stack, being interconnected by connectors 11*a* and 11*b*. The arrow F illustrates the direction of a force pulling the webs 2, 2' of the interconnected stacks. Said force F will be transmitted via the webs 2, 2' and in a direction along the length of said webs 2, 2'. Accordingly, the force F will be applied to the connection between the connectors 11*a* and 11*b* in a plane including the first and second connection surfaces. The connection strength of the connection provided by the first and second connectors 11*a*, 11*b* is at least equal to F, in order for the webs 2, 2' to be pulled along successfully.

Naturally, the pulling force to which the web is subjected may vary between different applications. Different types of web materials, and in particular different types of dispensers, might result in different forces on the web material to be pulled from the dispenser.

A person skilled in the art may select a suitable material for the connectors being aware of the requirements in the particular situation.

When it is referred to the strength of an interconnection herein, what is meant is the strength of the interconnection if the connectors are properly attached to each other. Generally, this would mean that at least the entire connection surface of one of the first and second connector is completely attached to the other connector.

(Naturally, interconnection could be accomplished also if the connectors are improperly interconnected, e.g. if only half of an intended connection surface is actually brought into contact with another surface.)

The connectors 11*a*, 11*b* may initially be provided with releasable cover sheets (20), as illustrated in FIG. 1'. The object of the cover sheets is principally to protect the connector surfaces from dirt or dust. The presence of dust or other contaminants on the surfaces may namely reduce their ability to interconnect. However, the connector surfaces as proposed herein have the advantage that they will not be permanently altered if subject e.g. to dust. Provided the connector surfaces are properly cleaned so as to remove any dust or other contaminants (e.g. swiped with a cleaning cloth), their ability to interconnect will be restored.

Connectors as those described herein are not prone to unintentional attachment. Since the connector surfaces shall be brought into close contact with each other for the surface adhesion to take place, it will usually be necessary to apply a slight pressure over the assembled connectors so as to accomplish the interconnection.

In many dispensers, particularly of the larger kind, the web material is to be run along a web path and through a number of devices before being fed to a user. Such devices could include various rollers, cutters, perforation cutters, and the like. Connectors as suggested herein are advantageous in that they may be designed such that they may pass these various devices without hindering the web, and without leaving any residues on the devices themselves.

In FIG. 1, the first and second connectors 11*a*, 11*b* are illustrated as having substantially the same size.

Figure 2:
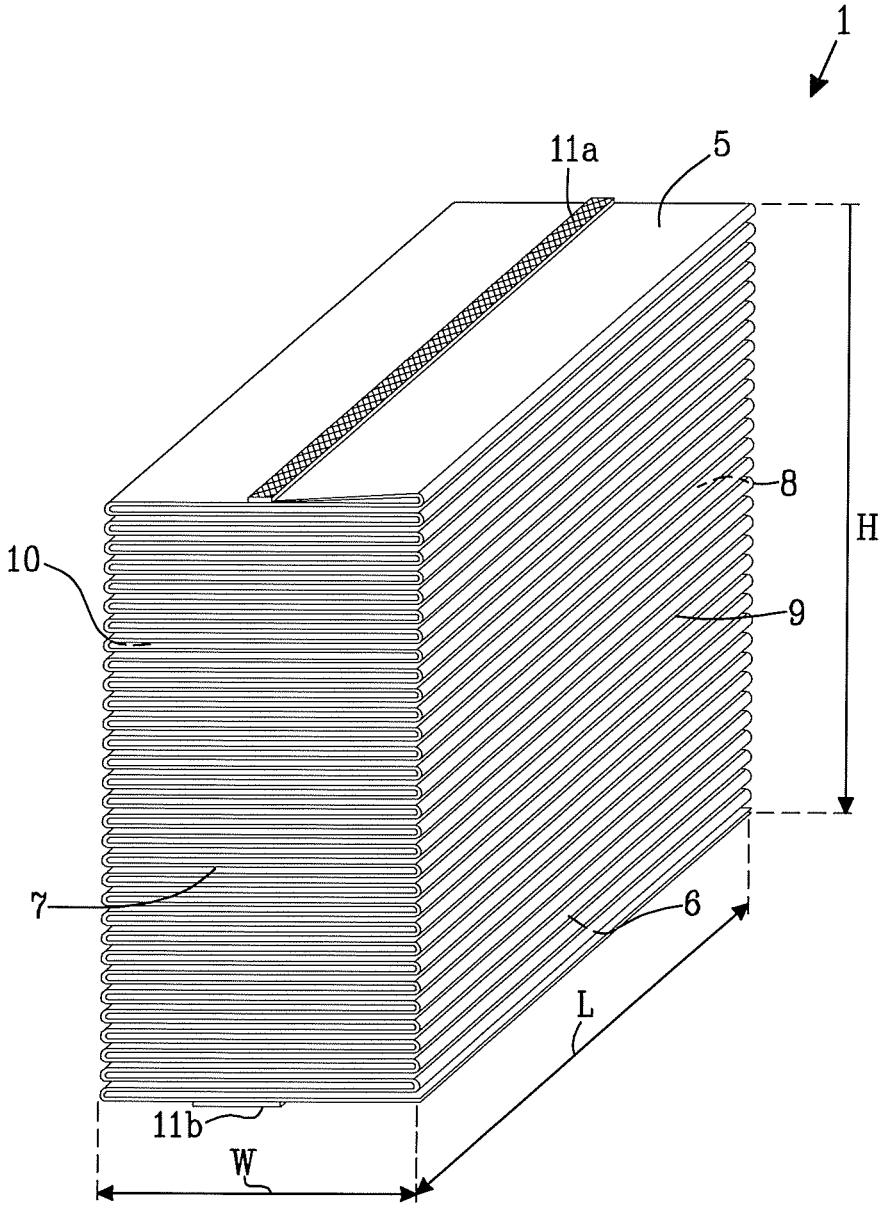
FIG. 2 illustrates another embodiment of a stack of web material comprising connectors.

FIG. 2 illustrates another example of a stack having a first and a second connector, where the area of the first connector 11*a* is less than the area of the second connector 11*b*. As illustrated in 2, the first connector 11*a* is in this case arranged on the top surface 5 of the stack, the second connector 11*b* is arranged on the bottom surface 6 of the stack 1. However, the opposite arrangement is naturally also possible.

Advantageously, the first connector may cover a panel area being less than 50% of the panel area covered by the second connection means, preferably less than 30% most preferred less than 20%. In the embodiment illustrated in FIG. 2, the area of the first connector 11*a* is about 25% of the area of the second connector 11*b*.

Each one the first and second connector may advantageously be symmetrically arranged in view of the width of the stack, preferably centrally arranged. When the first and second connectors are symmetrically arranged in view of the width of the stack, it is possible to turn the stacks in either way in this direction, and still achieve interconnection between the stacks.

Figure 3:
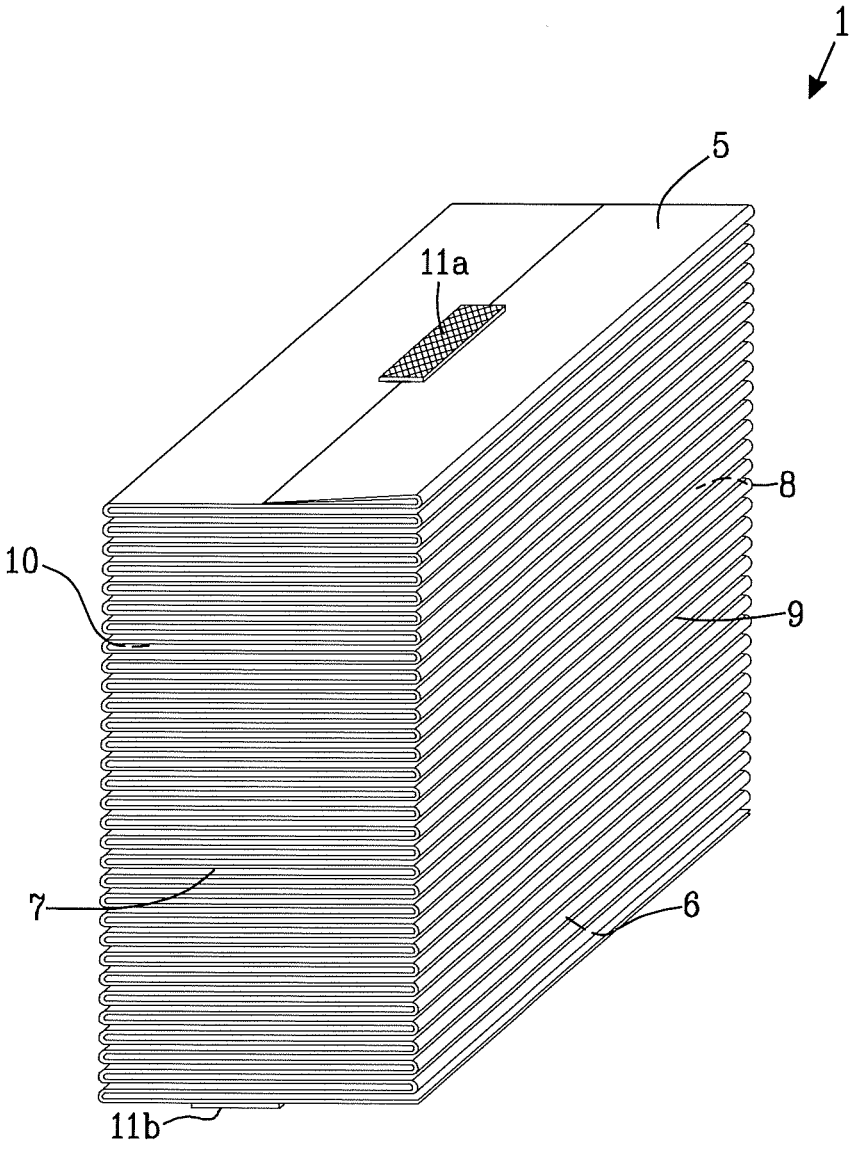
FIG. 3 illustrates yet another embodiment of a stack of web material comprising connectors.

In the illustrated examples of FIGS. 1-3, the first and second connectors 11*a* and 11*b* are symmetrically arranged in view of the width of the stack. Moreover, in this case they are centrally arranged in view of the width of the stack.

Also, the first and second connectors are symmetrically arranged in view of the length extension of the stack.

Advantageously, at least one of the first and second connectors, preferably both, extends along essentially the entire length (L) of the stack. This feature is advantageous for reasons of production, where a piece of material may conveniently be attached all over the length of the stack.

In the illustrated examples of FIGS. 1 and 2, both connectors 11*a*, 11*b* extend along the entire length of the stack 1. Hence, they are naturally symmetrically arranged in view of the length extension L of the stack 1.

FIG. 3 illustrates an alternative embodiment, where the first connector 11*a*, in this case arranged on the top side 5 of the stack 1, does not extend over the entire length L of the stack. Instead, the connector 11*a* comprises a smaller piece of material, being centrally arranged as seen both in the length direction, and in the width direction of the stack.

The embodiment of a first connector 11*a* as illustrated in FIG. 3 may for example be combined with a second connector 11*b* which extends over the entire length of the stack. In this case, the first connector 11*a* may have an area being less than 20% of the area of the second connector 11*b*.

In another variant, at least one of the first and second connectors, preferably both, extends along the majority of the length of the stack, leaving the side portions of the web free from connector. In this case, the connector may extend over more than 75% of the entire length, but less than 90% of the entire length. This variant may be advantageous in particular if the stack is intended for a particular dispenser being sensitive to added material at the edges of the web, perhaps if a relatively thick connector material is used.

At least one of the first and second connectors may consist of a continuous piece of connector material. In the illustrated embodiments, both connectors 11*a*, 11*b* consist of a continuous piece of material.

Alternatively, at least one of the first and second connectors comprises a plurality of pieces of connector material, intermittently arranged to said stack. Numerous arrangements are conceivable, with material pieces of different sizes and shapes, and arranged in various patterns.

The connectors may comprise connector material being adhesively attached to said stack. The connector material may be glued to said stack during production thereof, or the connector material may be provided as a sticker material being attached to the stack. Alternatively, the connector material may be sprayed or extruded directly onto the stack surface, and let to set so as to form a connector fastened to the stack surface.

For example, the first connector may have an extension in the width direction of the stack of less than 3 cm, preferably less than 1.5 cm, most preferred less than 0.5 cm.

The first connector may cover a panel area of less than 120 $cm^2$, preferably less than 60 $cm^2$, most preferred less than 30 $cm^2$.

The second connector may have an extension in the width direction of the stack of less than 8.5 cm, preferably less than 6 cm, most preferred less than 5 cm.

The second connector may cover a panel area of less than 120 $cm^2$, preferably less than 60 $cm^2$, most preferred less than 30 $cm^2$.

When the stack 1 comprises at least two webs 2, 3, e.g. as depicted in FIG. 4, the attachment of said connector 11 to the stack 1 may simultaneously accomplish interconnection of the first and second webs 2,3 at said connector 11.

Alternatively, the two webs 2,3 could be interconnected adjacent said connector 11 such that both webs 2,3 of the stack will be fed when the web of the other, interconnected stack 1 is pulled.

Interconnection of the first and second webs 2,3 at the connector 11 may be accomplished in many different manners.

When connectors as proposed herein are combined with stacks having relatively large heights, relatively many panels and/or relatively long web lengths therein, the refill procedure is facilitated not only in that the procedure of connecting the stacks to each other is easy to perform, but also because the number of connections to be performed for filling a designated storage space of a dispenser is diminished, as compared to the procedure when using prior art packages and stacks.

That fewer adhesions are necessary to perform the refill procedure also implies that the adhesions or connections between web material portions fed out from a dispenser including the present stacks will be distributed less frequently. Accordingly, the risk that a user is disturbed by the presence of such an adhesion or connection between webs is diminished. Moreover, the required amount of adhesion material is reduced.

For example, connectors may be present less frequently than at every 640th panel, preferably less frequently than at every 800th panel, most preferred less frequently than at every $1000^{th}$ panel. Besides from reducing the number of connection operations to be performed, this also reduces the likelihood that a user shall be supplied with a product including a connector.

The shear force between the first connector and the second connector, when interconnected, reflects the strength of the interconnection. The first and second connectors should, when connected, be able to resist the forces involved when the web of the interconnected stacks is pulled, such as when the interconnected web is drawn through a designated dispenser.

To ensure the proper feeding of the interconnected web, the interconnection of the first and second connectors should resist a shear force greater than the force required to pull a product of the web from the dispenser.

Moreover, if the web is provided with weakening lines, dividing the web into individual sheets, it is preferred that the interconnection between the first and second connectors is stronger than the force required for rupturing the web along the weakening lines. Accordingly, it is ensured that the web breaks at the weakening lines rather than at the interconnection between the connectors.

Advantageously, the first and second connector may each have a height of less than 0.75 mm, preferably less than 0.5 mm, most preferred 0.3 mm. Relatively small heights are desirable in particular when the interconnected web material of two stacks is to be pulled through a dispenser. Moreover, it may be generally desired to use relatively small heights, to ensure that the presence of the connectors is not perceived as disturbing to a user.

The height of the connector is intended to reflect the height added to the web material at the location of the connector. Accordingly, the height of the connector should include e.g. the thickness of any backing material being used.

Advantageously, a stack as proposed herein may be provided in a package for maintaining the integrity of the stack during transport and storage thereof.

Advantageously, the package may comprise a wrapper extending at least over the height (H) of the stack, so as to maintain the integrity of the stack during transport and storage thereof.

The term "wrapper" is to include various types of packages which may have different shapes, be made out of different materials etc. Many types of wrappers are known in the art.

Advantageously, the wrapper may be made by polymer materials or starch based materials. If desired, the wrapper may be made by recyclable material.

It is preferred that the wrapper is configured to be removable from the integrity of the stack.

The wrapper may comprise an opening feature for easy opening thereof.

Moreover, the wrapper may be provided with a visual indicium indicating a connection direction for correctly positioning the stack before interconnection thereof to another stack. This is useful when the first and second connectors are different, such that the interconnection of the stacks depends on a first connector meeting a second connector which is different from said first connector.

In a dispenser, the web material may be contained in a storage space, from which the material is drawn via a web path to a dispensing outlet of the dispenser. Advantageously, the storage space and path may be arranged such that the web material is fed from the top of the stack contained in the storage space.

For initial set-up of such a dispenser, a leading end of a first stack of web material must is usually be threaded through the dispenser, along the web path, and to the dispensing outlet. After initial threading, the web material may be drawn from the dispenser.

It is desired to replenish the dispenser with additional web material before the dispenser is completely empty. This is because the replenishment may then be made by interconnecting new web material to the web material remaining in the storage space. Hence, re-threading of the dispenser may be avoided.

Accordingly, in a typical situation, a dispenser to be replenished with web material comprises a housing having a storage space, where at least a portion of an initial, or remaining stack is present.

With stacks as described in the above, it is suggested to load such stacks in a dispenser including a housing having a storage space for storing at least two stacks, said storage space comprising at least a portion of an initial stack by providing a stack as described in the above, positioning said stack on a support surface, such that the stack rests on one of its outer surfaces facing said support surface; and interconnecting said stack with the initial stack, while the stack remains resting on said support surface.

Figure 5A:
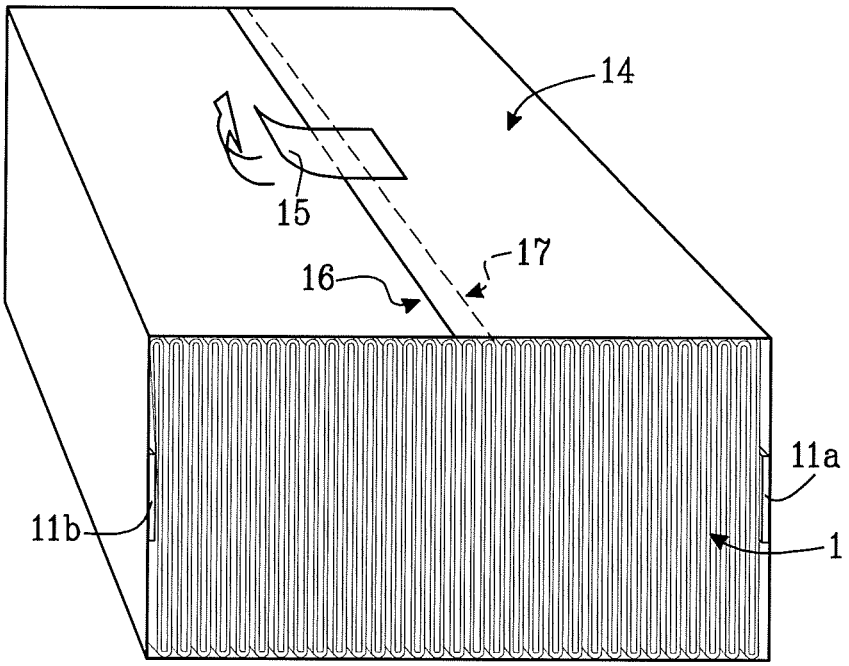
FIGS. 5*a* to 5*c* illustrate a method for opening a package including a wrapper and a stack
Figure 5B:
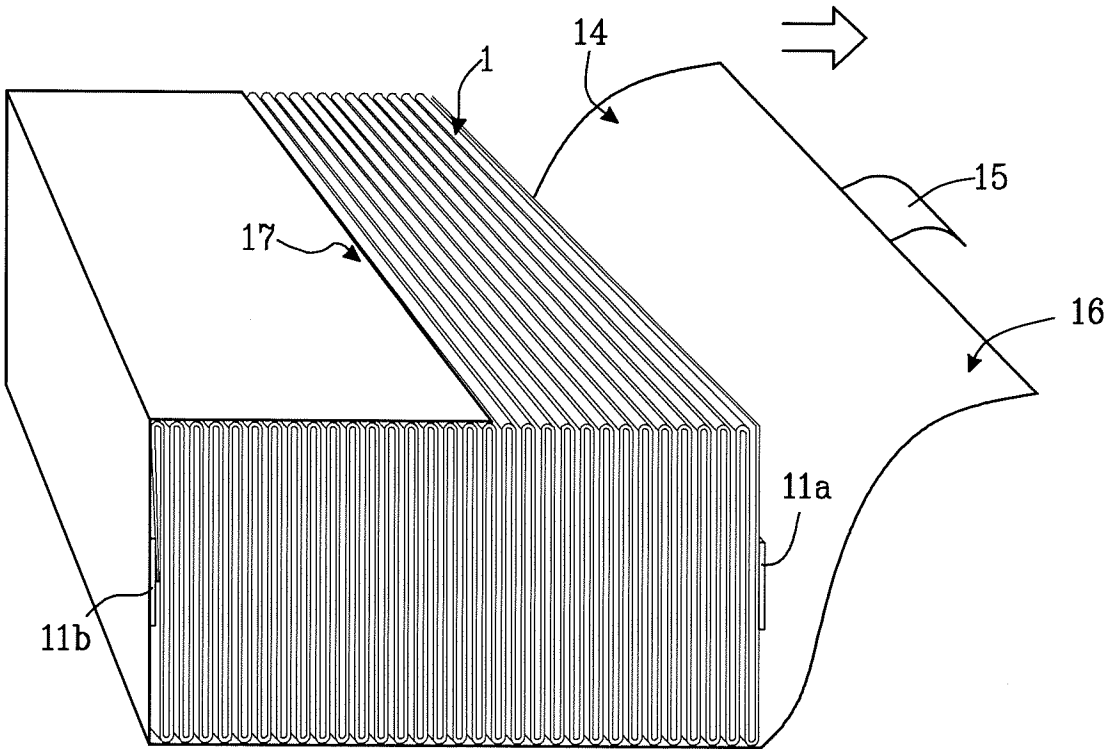
Figure 5C:
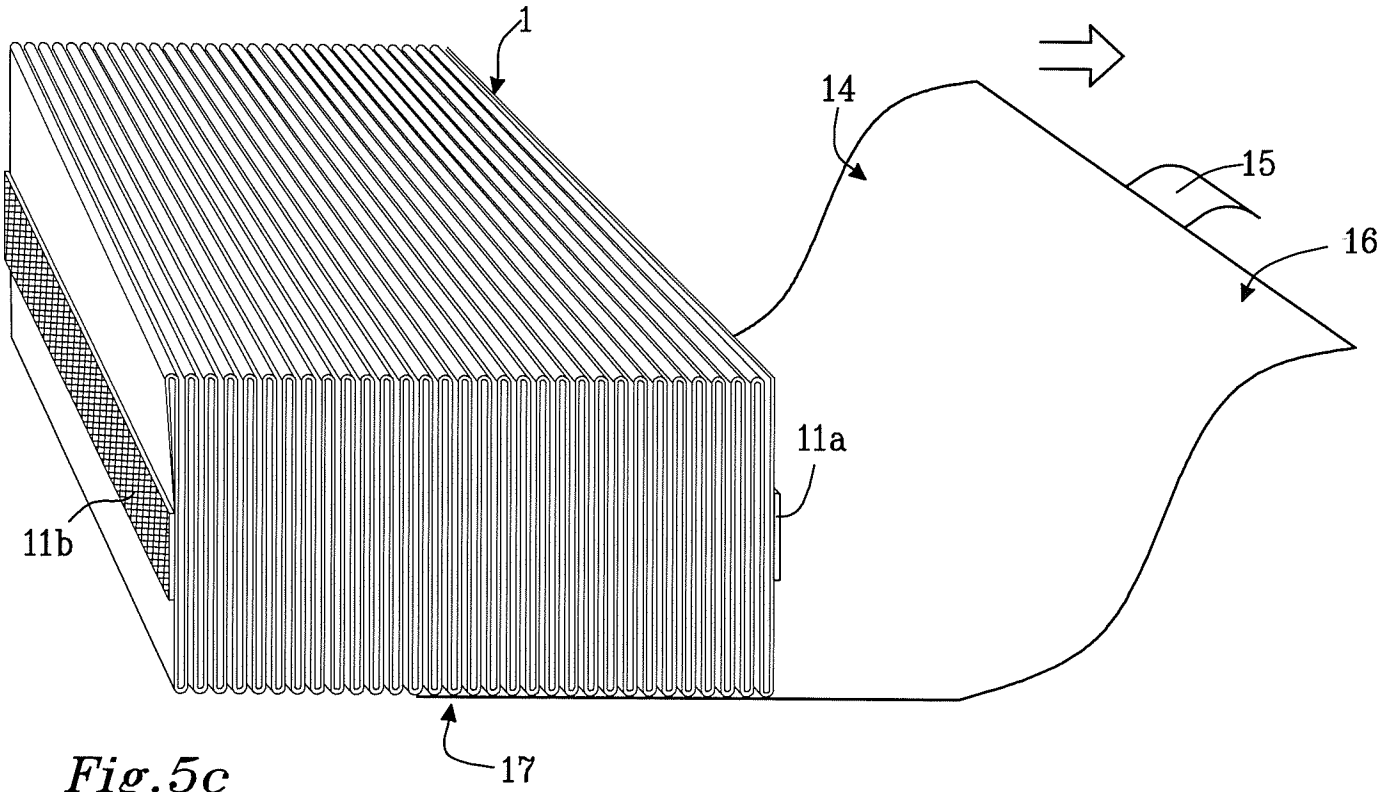

FIGS. 5*a*-5*c* illustrate a method for removing the wrapper 14 of the package in FIG. 2, or the package in FIG. 3, from the stack 1.

FIG. 5*a* illustrates a first step of positioning the package such that it is resting on an outer surface thereof, in this case the back surface 10. Hence, the package is resting on an outer surface which corresponds to the folded edges of the stack. Moreover, the package is resting on an outer surface being one of the largest surfaces of the stack. The front surface 9, where the wrapper 14 is provided with an opening feature including a gripper 15, is directed upwards. The gripper 15 may be gripped and pulled as indicated by the arrow in FIG. 5*a*, to open the package.

FIG. 5*b* illustrates the situation when the gripper 15 has been pulled, causing the wrapper to open such that a portion of the front surface of the stack 1 is revealed. Continued pulling of the gripper 15 in the direction of the arrow in FIG. 4*b* will result in removal of the wrapper 14 from the stack 1.

FIG. 5*c* illustrates the situation during continued pulling of the gripper 14. It is illustrated how the portion of the wrapper opposite the gripper 15 has been drawn from its initial location covering a portion of the front surface 9 of the stack 1, over the top/bottom surface of the stack 1, and finally underneath the stack 1. Hence, a portion of the wrapper 14 will slide between the back surface 10 of the stack and a support surface on which the package is resting. Continued pulling in the direction of the arrow will result in the final portion of the wrapper 14 sliding underneath the stack 1 such that the wrapper 14 is finally completely removed from the stack 1.

As illustrated in FIG. 5*a*-5*c*, this procedure for removal of the wrapper 14 from the stack 1 may be performed in one single movement by pulling the gripper 15 with a single hand.

In use, the procedure is to be performed when the package is resting on a support surface forming part of a storage space of a dispenser (or possibly on some surface being designed such that the stack may be pushed or slid into the storage space without need for manually maintaining its integrity).

When the wrapper 14 is removed from the stack in accordance with a method as described in the above, the wrapper 14 may slide over one or both of the connectors 11*a*, 11*b* of the stack. Accordingly, it is desired that the wrapper material is selected such that the wrapper slides easily over the connectors 11*a*, 11*b*, without becoming hindered thereof. To this end, the wrapper 14 may for example comprise an embossed plastic film, displaying a relatively low friction towards the connector surfaces.

Preferably, the storage space is arranged in said dispenser such that the web is to be fed from the top side of the stack.

In another aspect, there is proposed a compound stack comprising a plurality of stacks as described in the above, said stacks being interconnected via connectors, and said compound stack comprising interconnected connectors distributed less frequently than at every $640^{th}$ panel, preferably less frequently than at every $800^{th}$ panel, most preferred less frequently than at every $1000^{th}$ panel.

Moreover, there is provided a dispenser comprising a housing having a storage space including at least one stack as described in the above, preferably said storage space being arranged in the dispenser such that web material is fed from the top side of the stack.

Also, there is provided a dispenser comprising a housing having a storage space including a compound stack as described in the above, preferably said storage space being arranged in the dispenser such that web material is fed from the top side of the stack.

Numerous alternatives and variants are possible and may be envisaged by the person skilled in the art, in view of the above description.

Determination of the Connection Strength of Connections Between a First and a Second Connector The connection strength is the strength between a first and a second properly interconnected connector, and corresponds to the maximum force which the connection may withstand without breaking, the direction of said maximum force being comprised in a plane including the first and the second connection surfaces.

When the first and the second connector are subject to counter-acting forces comprised in a plane including the first and the second connection surfaces, a shear force will appear between the first and the second connector. The connection strength of the connection will reflect that maximum shear force which may appear between the first and the second connection surface, without breaking the adhesion between said surfaces.

Definitions

Fmax(N)—Maximum force recorded during testing

MD—Machine Direction

The maximum force required for separating the two webs, joined by a connection formed by a first connector attached to a second connector as described herein, is measured with a tensile strength tester.

Crosshead speed 50 mm/min

Clamp distance 100 mm 10N cell

Upper clamp with low weight

The width of the clamps may be selected to fit the samples.

Sample Preparation:

- Cut samples to the length of 150 mm, with the connection in the middle of the length direction. (One sheet will extend approximately 75 mm upwards from the connection, and the other sheet will extend approximately 75 mm downwards from the connection.)
- The sample width shall be the entire product width, and hence include the entire connection. Measure 10 samples in the machine direction.
- The samples shall be conditioned for 4 h at 50±2% rh and 23±1° C., in accordance with ISO-187 standard.
- To form the connection, the first connector and the second connector shall be brought into contact with each other with as large contact area between the first and the second connection surfaces as possible. To ensure that the first and second connectors are properly interconnected, a rubber roller (A80 shore), having a weight of 450 g, is rolled over the entire connection with a speed of 300 mm/min. The roller is rolled in a direction along the length of the connection (cross the length of the web material). The roller is rolled twice over the entire length of the connection to ensure proper interconnection.

Procedure

- Prepare the tensile testing apparatus according to the apparatus instruction.

Adjust the length between the clamps to 100 mm and zero the equipment in the starting position.

Place the first web of the sample in the upper clamp and the second in the lower clamp.

Start the tensile testing apparatus.

Repeat the test procedure for the remaining samples.

NB! Disregard samples which break elsewhere than between the first and the second connector forming the connection.

Calculation and Expression of Results

The software of the tensile strength tester records the highest peak force detected during a test run of a sample. This maximum force (N) is used as a measure of the connection strength of the connection of the sample. A mean value of the maximum force (N) of 10 samples is regarded as a representative value of the connection strength of the connection of the sample.

N.B. The samples are to be similar. Hence, they comprise similar web materials and connections. The resulting measure is to be representative of the selected combination of web material and connection.

It is to be understood, that for the purpose of finding a connection which is suitable for a particular application, it is sufficient to determine that the connection may resist the forces involved when pulling the web material in said application. To this end, it is usually not necessary to determine the maximum connection strength which the connection may provide before breaking. Instead, it is sufficient to determine that the connection is sufficiently strong for use in the particular application.

For determination of the separation strength of a weakening line in a web material, a method similar to the one described in the above may be used. In this case, the weakening line will be positioned in the centre of the sample instead of the connection, and the tensile tester will be used to determine the separation strength of the weakening line.

The invention claimed is:

1. A stack of web material for hygiene products, comprising:

at least one web material being Z-folded about transverse folding lines, thereby providing panels having a length along said folding lines, and a width perpendicular to said folding lines, said panels being piled on top of each other to form a height of said stack extending between a first end surface and a second end surface of the stack, and said first end surface being provided with a first connector, and said second end surface being provided with a second connector, said first connector and said second connector being adapted for interconnection of the first end surface of the stack to a second end surface of another, similar stack, and/or for interconnection of the second end surface of the stack to a first end surface of another, similar stack, wherein said first connector comprises a first smooth connection surface consisting of a first material, said second connector comprises a second smooth connection surface consisting of a second material; and said first material and said second material being polymer materials which have been sprayed or extruded onto the stack or which are provided in the form of a film provided on the stack and having properties so that, upon bringing said first connection surface and said second connection surface into contact with each other, the first connection surface and the second connection surface attach to each other by surface adhesion of a kind where the first connection surface and the second connection surface are repeatedly removable from and reattachable to each other while leaving the first connection surface and the second connection surface substantially unaltered, whereby a connection between a first connector/second connector of the stack and a second connector/first connector of a similar stack is accomplished, said connection having a connection strength in a plane including the first connection surface and the second connection surface sufficient to pull the web material of the interconnected stacks, wherein the stack is configured to be pulled through a dispenser.

2. A stack in accordance with claim 1, wherein said connection strength is at least 1 N.

3. A stack in accordance with claim 1, wherein said first material and said second material are selected such that, upon bringing said first connection surface or said second connection surface into contact with the web material, no surface adhesion occurs.

4. A stack in accordance with claim 1, wherein said first material and said second material are selected such that the first connection surface and the second connection surface attach to each other by surface adhesion caused by intermolecular interactions.

5. A stack in accordance with claim 4, wherein at least one of said first connection surface and the second connection surface displays a microstructure.

6. A stack in accordance with claim 1, wherein said surface adhesion comprise diffusive adhesion.

7. A stack in accordance with claim 1, wherein said surface adhesion comprise electrostatic adhesion.

8. A stack in accordance with claim 1, wherein at least one of the first connector and the second connector consists of a homogenous piece of material forming the connection surface of a respective one of the first connector and the second connector.

9. A stack in accordance with claim 1, wherein at least one of the first connector and the second connector comprises a layer of a material forming the connection surface of a respective one of the first connector and the second connector.

10. A stack in accordance with claim 1, wherein at least one of the first connector and the second connector is covered by a removable release material.

11. A stack in accordance with claim 1, comprising a fastener which fastens at least one of the first connector and the second connector to the stack.

12. A stack in accordance with claim 1, wherein at least one of the first connector and the second connector is formed by a material being formed directly on the stack.

13. A stack in accordance with claim 1, wherein said web material is continuous.

14. A stack in accordance with claim 1, provided with a wrapper encircling said stack, the wrapper being slidable against said first connector and said second connector, such that the wrapper may be removed from the stack without being hindered by the first connector and said second connector.

15. A compound stack comprising a first and a second stack in accordance with claim 1, said first stack and said second stack being interconnected via one of the first connector and the second connector of the first stack and one of the first connector and the second connector of the second stack.

16. A method for interconnecting the stack of folded web material according to claim 1 with another, similar stack, the method comprising:

bringing said first connection surface and said second connection surface into close contact with each other, so that the first connection surface and the second connection surface attach to each other by the surface adhesion.

* * * * *